US009962821B2

(12) United States Patent
Pedicini et al.

(10) Patent No.: US 9,962,821 B2
(45) **Date of Patent: *May 8, 2018**

(54) FASTENER DRIVING APPARATUS

(71) Applicant: Tricord Solutions, Inc., Franklin, TN (US)

(72) Inventors: Christopher Pedicini, Franklin, TN (US); John Witzigreuter, Canton, GA (US)

(73) Assignee: Tricord Solutions, inc., Franklin, TN (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/338,433

(22) Filed: Oct. 30, 2016

(65) Prior Publication Data

US 2017/0100829 A1 Apr. 13, 2017

Related U.S. Application Data

(63) Continuation-in-part of application No. 14/877,742, filed on Oct. 7, 2015, and a continuation-in-part of application No. 15/012,498, filed on Feb. 1, 2016, now Pat. No. 9,539,714.

(60) Provisional application No. 62/362,872, filed on Jul. 15, 2016, provisional application No. 62/374,565, filed on Aug. 12, 2016.

(51) Int. Cl.
*B25C 1/04* (2006.01)
*B25C 1/06* (2006.01)

(52) U.S. Cl.
CPC ..... *B25C 1/06* (2013.01); *B25C 1/047* (2013.01)

(58) Field of Classification Search
CPC ..... B25C 1/04; B25C 1/06; B25C 1/047
See application file for complete search history.

(56) References Cited

U.S. PATENT DOCUMENTS 2,887,686 A * 5/1959 Wandel ..... B25C 1/04 173/112
4,215,808 A * 8/1980 Sollberger ..... B25C 1/041 173/204
5,720,423 A * 2/1998 Kondo ..... B25C 1/04 227/130
7,793,811 B1 * 9/2010 Pedicini ..... B25C 1/047 227/130
8,011,441 B2 * 9/2011 Leimbach ..... B25C 1/047 173/1
8,079,504 B1 * 12/2011 Pedicini ..... B25C 1/04 227/130

(Continued)

*Primary Examiner* — Andrew M Tecco
(74) *Attorney, Agent, or Firm* — Jay Schloff; Aidenbaum Schloff and Bloom PLLC

(57) ABSTRACT

A fastener driving apparatus includes a spring anvil assembly that comprises a gas spring and an anvil. The end of the piston that extends out of the gas spring may be fixedly disposed against an object that is capable of exerting a force against the piston for at least a portion of the operational cycle. A drive mechanism acts on the spring assembly to store potential energy in the spring. The drive mechanism thereafter ceases acting on the spring assembly and the potential energy is released, causing the spring anvil assembly move and to separate from the drive mechanism for a period of free flight of the spring anvil assembly, the anvil thereafter moving to strike a fastener to drive the fastener into a substrate.

19 Claims, 7 Drawing Sheets

(56) References Cited

U.S. PATENT DOCUMENTS

| | | | | |
|---|---|---|---|---|
| 8,602,282 | B2 * | 12/2013 | Leimbach | B25C 1/047 227/130 |
| 8,763,874 | B2 * | 7/2014 | McCardle | B25C 1/047 227/129 |
| 8,800,834 | B2 * | 8/2014 | Pedicini | B25C 1/04 227/10 |
| 9,636,812 | B2 * | 5/2017 | Pedicini | B25C 1/041 |
| 2007/0045377 | A1 * | 3/2007 | Towfighi | B25C 1/06 227/130 |
| 2014/0054350 | A1 * | 2/2014 | Pedicini | B25C 5/15 227/8 |

* cited by examiner

FASTENER DRIVING APPARATUS

CROSS REFERENCE TO RELATED APPLICATIONS

The present disclosure claims priority under 35 United States Code, Section 119 on U.S. Provisional Patent Application No. 62/362,872, filed on Jul. 15, 2016 and U.S. Provisional Patent Application No. 62/374,565, filed on Aug. 12, 2016, the disclosures of which are incorporated by reference. It also is a continuation in part of and claims priority 35 United States Code, Section 120 to U.S. Nonprovisional patent application Ser. No. 14/877,742, filed on Oct. 7, 2015 and U.S. Nonprovisional patent application Ser. No. 15/012,498, filed on Feb. 1, 2016, the disclosures of which are incorporated by reference.

FIELD OF THE DISCLOSURE

The present disclosure relates to fastener driving apparatuses, and, more particularly, to such fastener or staple driving mechanisms that require operation as a hand tool.

BACKGROUND

Electromechanical fastener driving apparatuses (also referred to herein as a "driver," "gun" or "device") known in the art often weigh generally less than 15 pounds and may be configured for an entirely portable operation. Contractors and homeowners commonly use power-assisted devices and means of driving fasteners into wood. These power-assisted means of driving fasteners can be either in the form of finishing fastener systems used in baseboards or crown molding in house and household projects, or in the form of common fastener systems that are used to make walls or hang sheathing onto same. These systems can be portable (i.e., not connected or tethered to an air compressor or wall outlet) or non-portable.

The most common fastener driving apparatus uses a source of compressed air to actuate a guide assembly to push a fastener into a substrate. For applications in which portability is not required, this is a very functional system and allows rapid delivery of fasteners for quick assembly. A disadvantage is that it does however require that the user purchase an air compressor and associated air-lines in order to use this system. A further disadvantage is the inconvenience of the device being tethered (through an air hose) to an air compressor.

To solve this problem, several types of portable fastener drivers operate off of fuel cells. Typically, these guns have a guide assembly in which a fuel is introduced along with oxygen from the air. The subsequent mixture is ignited with the resulting expansion of gases pushing the guide assembly and thus driving the fastener into the workpieces. This design is complicated and is far more expensive than a standard pneumatic fastener gun. Both electricity and fuel are required as the spark source derives its energy typically from batteries. The chambering of an explosive mixture of fuel, the use of consumable fuel cartridges, the loud report and the release of combustion products are all disadvantages of this solution. Systems such as these are already in existence and are sold commercially to contractors under the Paslode™ name.

Another commercially available solution is a fastener gun that uses electrical energy to drive a stapler or wire brad. Such units typically use a solenoid to drive the fastener (such as those commercially available under the Arrow™ name or those which use a ratcheting spring system such as the Ryobi™ electric stapler). These units are limited to short fasteners (typically 1" or less), are subject to high reactionary forces on the user and are limited in their repetition rate. The high reactionary force is a consequence of the comparatively long time it takes to drive the fastener into the substrate. Additionally, because of the use of mechanical springs or solenoids, the ability to drive longer fasteners or larger fasteners is severely restricted, thus relegating these devices to a limited range of applications. A further disadvantage of the solenoid driven units is they often must be plugged into the wall in order to have enough voltage to create the force needed to drive even short fasteners.

A final commercially available solution is to use a flywheel mechanism and clutch the flywheel to an anvil that drives the fastener. Examples of such tools can be found under the Dewalt™ name. This tool is capable of driving the fasteners very quickly and in the longer sizes. The primary drawback to such a tool is the large weight and size as compared to the pneumatic counterpart. Additionally, the drive mechanism is very complicated, which gives a high retail cost in comparison to the pneumatic fastener gun.

Clearly based on the above efforts, a need exists to provide portable solution to driving fasteners which is unencumbered by fuel cells or air hoses. Additionally, the solution ought to provide a low reactionary feel, be able to drive full size fasteners and be simple, cost effective and robust in operation.

The prior art teaches several additional ways of driving a fastener or staple. The first technique is based on a multiple impact design. In this design, a motor or other power source is connected to an impact anvil through either a lost motion coupling or other device. This allows the power source to make multiple impacts on the fastener to drive it into the workpiece. The disadvantages in this design include increased operator fatigue since the actuation technique is a series of blows rather than a single drive motion. A further disadvantage is that this technique requires the use of an energy absorbing mechanism once the fastener is seated. This is needed to prevent the anvil from causing excessive damage to the substrate as it seats the fastener. Additionally, the multiple impact designs are not very efficient because of the constant motion reversal and the limited operator production speed.

A second design that is taught in U.S. Pat. Nos. 3,589,588, 5,503,319, and 3,172,121 includes the use of potential energy storage mechanisms (in the form of a mechanical spring). In these designs, the spring is cocked (or activated) through an electric motor. Once the spring is sufficiently compressed, the energy is released from the spring into the anvil (or fastener driving piece), thus pushing the fastener into the substrate. Several drawbacks exist to this design. These include the need for a complex system of compressing and controlling the spring, and in order to store sufficient energy, the spring must be very heavy and bulky. Additionally, the spring suffers from fatigue, which gives the tool a very short life. Finally, metal springs must move a significant amount of mass in order to decompress, and the result is that these low-speed fastener drivers result in a high reactionary force on the user.

To improve upon this design, an air spring has been used to replace the mechanical spring. U.S. Pat. No. 4,215,808 teaches of compressing air within a guide assembly and then releasing the compressed air by use of a gear drive. This patent overcomes some of the problems associated with the mechanical spring driven fasteners described above, but is subject to other limitations. One particular troublesome issue with this design is the safety hazard in the event that the anvil jams on the downward stroke. If the fastener jams or buckles within the feeder and the operator tries to clear the jam, he is subject to the full force of the anvil, since the anvil is predisposed to the down position in all of these types of devices. A further disadvantage presented is that the fastener must be fed once the anvil clears the fastener on the backward stroke. The amount of time to feed the fastener is limited and can result in jams and poor operation, especially with longer fasteners. A further disadvantage to the air spring results from the need to have the ratcheting mechanism as part of the anvil drive. This mechanism adds weight and causes significant problems in controlling the fastener drive since the weight must be stopped at the end of the stroke. This added mass slows the fastener drive stroke and increases the reactionary force on the operator. Additionally, because significant kinetic energy is contained within the air spring and piston assembly the unit suffers from poor efficiency. This design is further subject to a complicated drive system for coupling and uncoupling the air spring and ratchet from the drive train which increases the production cost and reduces the system reliability.

U.S. Pat. No. 5,720,423 again teaches of an air spring that is compressed and then released to drive the fastener. The drive or compression mechanism used in this device is limited in stroke and thus is limited in the amount of energy which can be stored into the air stream. In order to provide sufficient energy in the air stream to achieve good performance, this patent teaches use of a gas supply which preloads the guide assembly at a pressure higher than atmospheric pressure. Furthermore, the compression mechanism is bulky and complicated. In addition, the timing of the motor is complicated by the small amount of time between the release of the piston and anvil assembly from the drive mechanism and its subsequent re-engagement. Additionally, U.S. Pat. No, 5,720,423 teaches that the anvil begins in the retracted position, which further complicates and increases the size of the drive mechanism. Furthermore, because of the method of activation, these types of mechanisms as described in U.S. Pat. Nos. 5,720,423 and 4,215,808 must compress the air to full energy and then release off the tip of the gear while under full load. This method of compression and release causes severe mechanism wear. As will be discussed below, the present disclosure overcomes these and other limitations in the prior art use of air springs.

A third means for driving a fastener that is taught includes the use of flywheels as energy storage means. The flywheels are used to actuate a hammering anvil that impacts the fastener. This design is described in detail in U.S. Pat. Nos. 4,042,036, 5,511,715, and 5,320,270. One major drawback to this design is the problem of coupling the flywheel to the driving anvil. This prior art teaches the use of a friction clutching mechanism that is both complicated, heavy and subject to wear. Further limiting this approach is the difficulty in controlling the energy in the fastener system. The mechanism requires enough energy to drive the fastener, but retains significant energy in the flywheel after the drive is complete. This further increases the design complexity and size of such prior art devices.

A fourth means for driving a fastener is taught in the present inventors' U.S. Pat. No. 8,079,504, which uses a compression on demand system with a magnetic detent. This system overcomes many of the advantages of the previous systems but still has its own set of disadvantages which include the need to retain a very high pressure for a short period of time. This pressure and subsequent force necessitate the use of high strength components and more expensive batteries and motors.

A fifth means is taught in pending U.S. Pat. No. 8,733,610, which uses a vacuum to drive a fastener drive assembly. This clearly has its own advantages over the previous systems but has its own set of disadvantages, including the need to retain a seal against air pressure. This sealing requirement necessitates the use of more accurate cylinders and pistons, thus contributing to the manufacturing cost.

A sixth means taught in U.S. Pat. No. 8,602,282 clearly teaches a gas spring wherein the gas spring traverses the entire stroke of the drive anvil and wherein the spring is energized during the entire stroke. This means is similar to what is used in US Patent Application Publication 2012/0325887 wherein a flywheel or gyrating mass has been added to what is disclosed in U.S. Pat. No. 8,602,282. Both of these patents clearly have sets of disadvantages when it comes to safety, as the anvil or hammer mechanism is fully powered under the down stroke. Additionally, these references teach of a gas spring drive that remains connected the anvil the entire time of operation and thus has efficiency losses and wear due to seal issues. Furthermore, the integration of a clutch and a gyrating mass causes spool up issues and can further reduce efficiency.

All of the currently available devices suffer from one or more the following disadvantages:

- Complex, expensive and unreliable designs. Fuel powered mechanisms such as Paslode™ achieve portability but require consumable fuels and are expensive. Rotating flywheel designs such as Dewalt™ have complicated coupling or clutching mechanisms based on frictional means. This adds to their expense.
- Poor ergonomics. The fuel powered mechanisms have loud combustion reports and combustion fumes. The multiple impact devices are fatiguing and are noisy.
- Non-portability. Traditional fastener guns are tethered to a fixed compressor and thus must maintain a separate supply line.
- High reaction force and short life. Mechanical spring driven mechanisms have high tool reaction forces because of their long fastener drive times. Additionally, the springs are not rated for these types of duty cycles leading to premature failure. Furthermore, consumers are unhappy with their inability seat longer fasteners or work with denser wood species.
- Safety issues. The prior art "air spring" and heavy spring driven designs suffer from safety issues for longer fasteners since the predisposition of the anvil is towards the substrate. During jam clearing, this can cause the anvil to strike the operators hand.
- Low efficiency as a result of the need to spin up a large gyrating mass or gas springs which have strokes that are similar in length to the drive stroke of the fastener.

In light of these various disadvantages, there exists the need for a fastener driving apparatus that overcomes these various disadvantages of the prior art and can give a similar user experience to a pneumatic tool, while still retaining the benefits of the prior art.

SUMMARY OF THE INVENTION

In accordance with the present invention, a fastener driving apparatus is described which derives its power from an electrical source (preferably rechargeable batteries), and uses a motor to actuate a spring anvil assembly. The spring anvil assembly further comprises an anvil and a spring which may be a gas spring for example. In the case that the spring anvil assembly comprises a gas spring, the anvil is attached at a location that is distal to the piston exit of the gas spring. The end of the piston that extends out of the gas spring may be fixedly disposed against an object that is capable of exerting a force against the piston (such as a plate, also referred to hereafter as a pusher plate) for at least a portion of the operational cycle. After sufficient potential energy has been stored in the spring the energy is released causing the spring anvil assembly to move which anvil thereafter may strike a fastener to drive the fastener into a substrate. The gas spring of the present disclosure may contain air or, in another embodiment a non oxidizing gas such as nitrogen or in still a further embodiment an inert gas such as argon.

In a further embodiment, the assembly impacts a bumper at one or both ends of the stroke to minimize any damage to the mechanism. A spring (mechanical or gas), a bungee or other return mechanism is incorporated to return the anvil assembly, after the anvil drives the fastener, to a position wherein the drive mechanism is able to store potential energy again within the spring for another fastener drive by the anvil. In a further embodiment, this return mechanism is part of the moving mass which improves efficiency.

In the case of a gas spring, we unexpectedly discovered that by limiting the stroke of gas spring piston to a fraction of the fastener drive stroke we achieved a number of advantages. First, the present fastener driving assembly is able to generate sufficient energy to drive a fastener with only a small increase in pressure in the chamber, cylinder or other environment in which the gas spring piston is disposed. This increases the efficiency of the apparatus since heat of compression of a gas is a significant source of energy inefficiency in prior art fastener driving apparatuses. This aspect also reduces the size of the apparatus, as the stroke of the gas piston is significantly less than the stroke of the anvil. Another unexpected result is the high efficiency of the apparatus as compared to the inventors' vacuum-actuated fastener driver apparatus (U.S. Pat. No. 8,079,504) and to U.S. Pat. No. 8,602,282. Seal friction is a known major source of efficiency reduction. By limiting the stroke of the gas piston spring in relation to the stroke of the anvil, the length over which the seal friction loss occurs is significantly reduced. This is a major unexpected benefit of the present disclosure, dramatically increasing the efficiency and also reducing wear over the prior art. For instance, test results show conversion efficiencies (potential energy to kinetic energy in the drive anvil) of over 80% and even approaching 90%, which is far better than the 65% obtained by the apparatus of the '504 patent. During the inventive process, it was unexpectedly discovered that by incorporating the mass of the piston in the anvil assembly that the efficiency increased over the authors' prior invention in that kinetic energy of both the piston and the anvil assembly are available to drive the fastener.

The fastener driving cycle of the apparatus disclosed herein may start with an electrical signal, after which a circuit connects a motor to the electrical power source. The motor is coupled to the gas spring through a drive mechanism such as a cam or other actuating mechanism. In an operational cycle of the drive mechanism, the mechanism alternatively (1) energizes the spring anvil assembly such as by acting on a cam follower that is disposed, for example, on the housing of the gas spring and (2) decouples from the spring anvil assembly. For example, during a portion of its cycle, the drive mechanism may move the piston to increase potential energy stored within the gas spring. In the next step of the cycle, the mechanism decouples from the piston to allow the accumulated potential energy within the gas spring to act on and actuate the piston and/or gas spring and/or anvil. The piston may thereupon push against the pusher plate converting potential energy stored in the gas spring into kinetic energy of the anvil to have the anvil drive a fastener. A spring or other return mechanism is operatively coupled to the spring anvil assembly to return the spring anvil assembly to an initial position. The drive mechanism may thereafter reengage the spring anvil assembly to again perform the operational cycle. In an embodiment, at least one bumper is disposed in proximity to the gas spring to reduce the wear on the piston. In an embodiment another bumper is used to reduce the wear on the anvil assembly that otherwise may occur in operation of the fastener driving apparatus. In a further embodiment a bumper may be used between the gas spring piston and the pusher plate to reduce wear on the apparatus In an embodiment, the anvil and the fastener have less than 25 mm of overlap and preferably less than 5 mm overlap at the position of minimum potential energy storage in the gas spring. In an embodiment, the stroke or movement of the piston is less than one half the total movement of the anvil. In another embodiment, the movement of the piston results in a volume decrease within the gas spring chamber of less than 20% of the initial volume (which thus minimizes or reduces losses from heat of compression.)

In an embodiment, a sensor and a control circuit are provided for determining at least one position of the gas spring, drive mechanism and/or anvil. The sensor may provide for enabling the proper timing for stopping the operational cycle or for re-energizing the gas spring of the apparatus. Further, this information can be used to detect a jam condition for proper recovery.

In an embodiment, the piston ceases to exert force on the pusher plate (or otherwise generates a sufficient amount of kinetic energy to thereafter allow the anvil to drive a fastener) at less than 40% of the total fastener stroke and preferably less than 5% of the fastener stroke. This results in an improved safety profile in the event of a jam, as the anvil will have dissipated its kinetic energy in the jam, thus allowing the user to fix the jam with minimal potential energy remaining in the spring anvil assembly. It was unexpectedly discovered that this also increases the efficiency and life of the apparatus. Seal friction is significant source of energy loss in pneumatics, by reducing the stroke of the drive piston efficiency is increased and seal wear is reduced.

In an embodiment, a locking mechanism (such as a sprocket and pawl or a one-way clutch) is used to provide an intermediate stopping point after the gas spring has been partially energized. This locking mechanism retains the drive mechanism and gas spring in place once power is removed from the motor. This allows a portion of the potential energy to be stored in the gas spring and thus reduces the latency of the apparatus. For purposes of the present disclosure, latency is defined as the period between a user-initiated action such as a trigger pull and the delivery of a nail. In an embodiment, the latency is less than 100 milliseconds, which period appears to be instantaneous to the user.

Accordingly, and in addition to the objects and advantages of the portable electric fastener gun as described above, several objects and advantages of the present invention are:

To provide a simple design for driving fasteners that has a significantly lower production cost than currently available nail guns and that is portable and does not require an air compressor.

To provide a fastener driving device that mimics the pneumatic fastener performance without a tethered air compressor.

To provide an electrical driven high power fastening device that has very little wear.

To provide an electric motor driven fastener driving device in which energy is not stored behind the fastener driving anvil, thus greatly enhancing tool safety.

To provide an electric motor driven fastener in which the latency is reduced, thus improving the user experience.

To provide a more energy efficient mechanism for driving nails than is presently achievable with a compressed air or vacuum design.

These together with other aspects of the present disclosure, along with the various features of novelty that characterize the present disclosure, are pointed out with particularity in the claims annexed hereto and form a part of the present disclosure. For a better understanding of the present disclosure, its operating advantages, and the specific objects attained by its uses, reference should be made to the accompanying drawings and detailed description in which there are illustrated and described exemplary embodiments of the present disclosure.

DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DISCLOSURE

Figure 1:
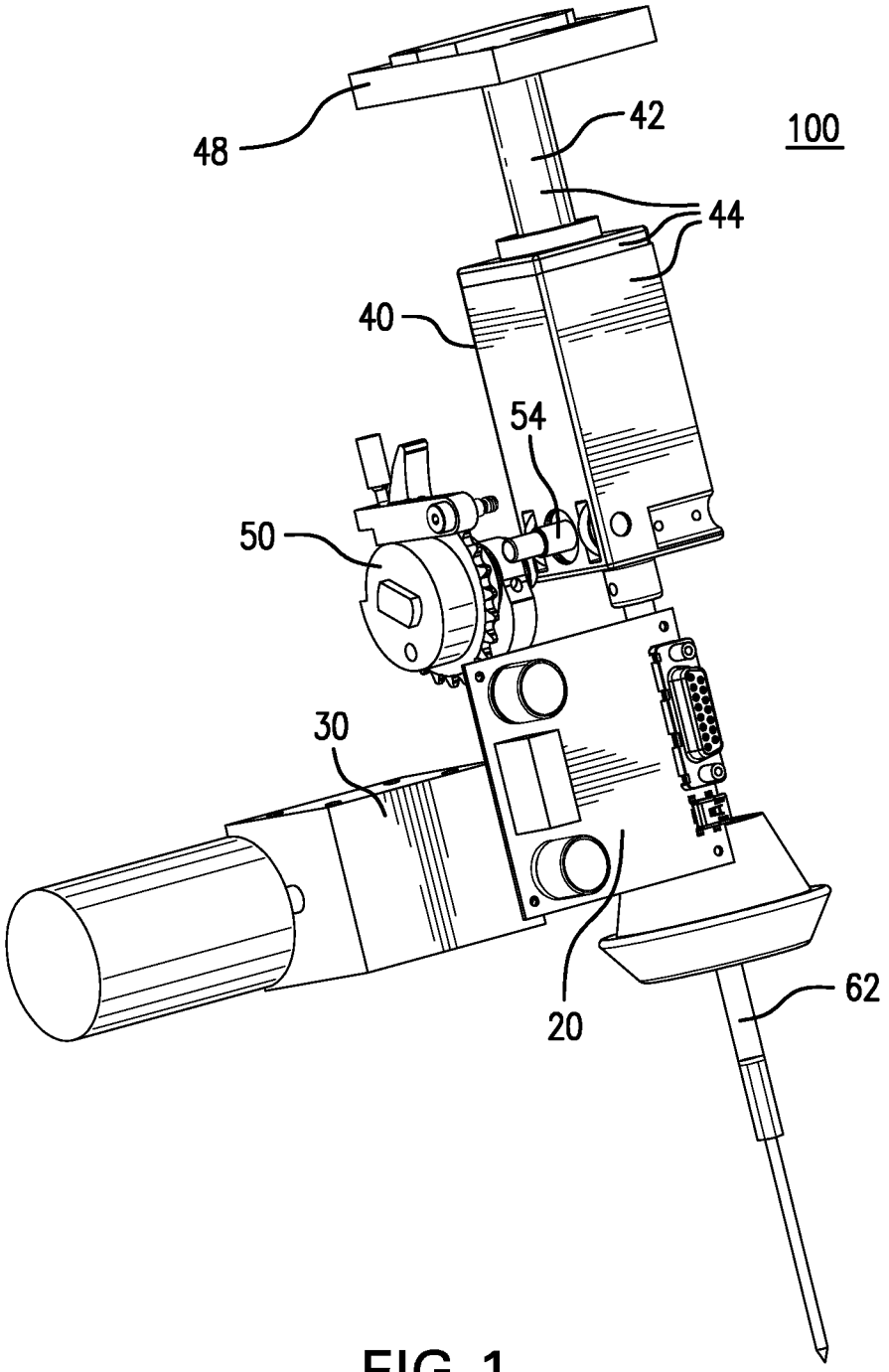
FIG. 1 shows a cutaway view of a fastener driving apparatus, in accordance with an exemplary embodiment of the present disclosure.
Figure 2:
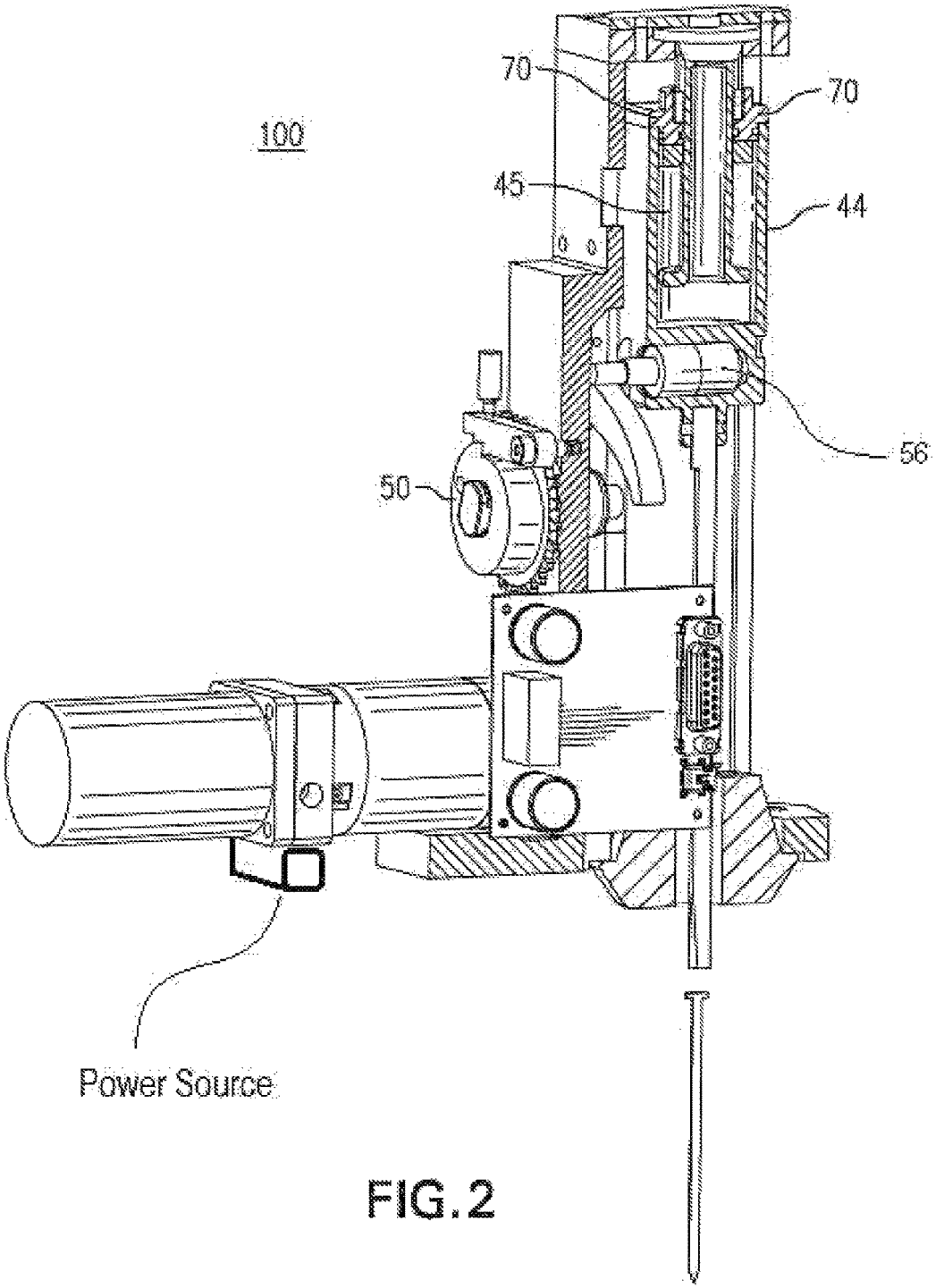
FIG. 2 shows a cutaway view of a fastener driving apparatus, in accordance with an exemplary embodiment of the present disclosure wherein a gas spring is storing potential energy.
Figure 3:
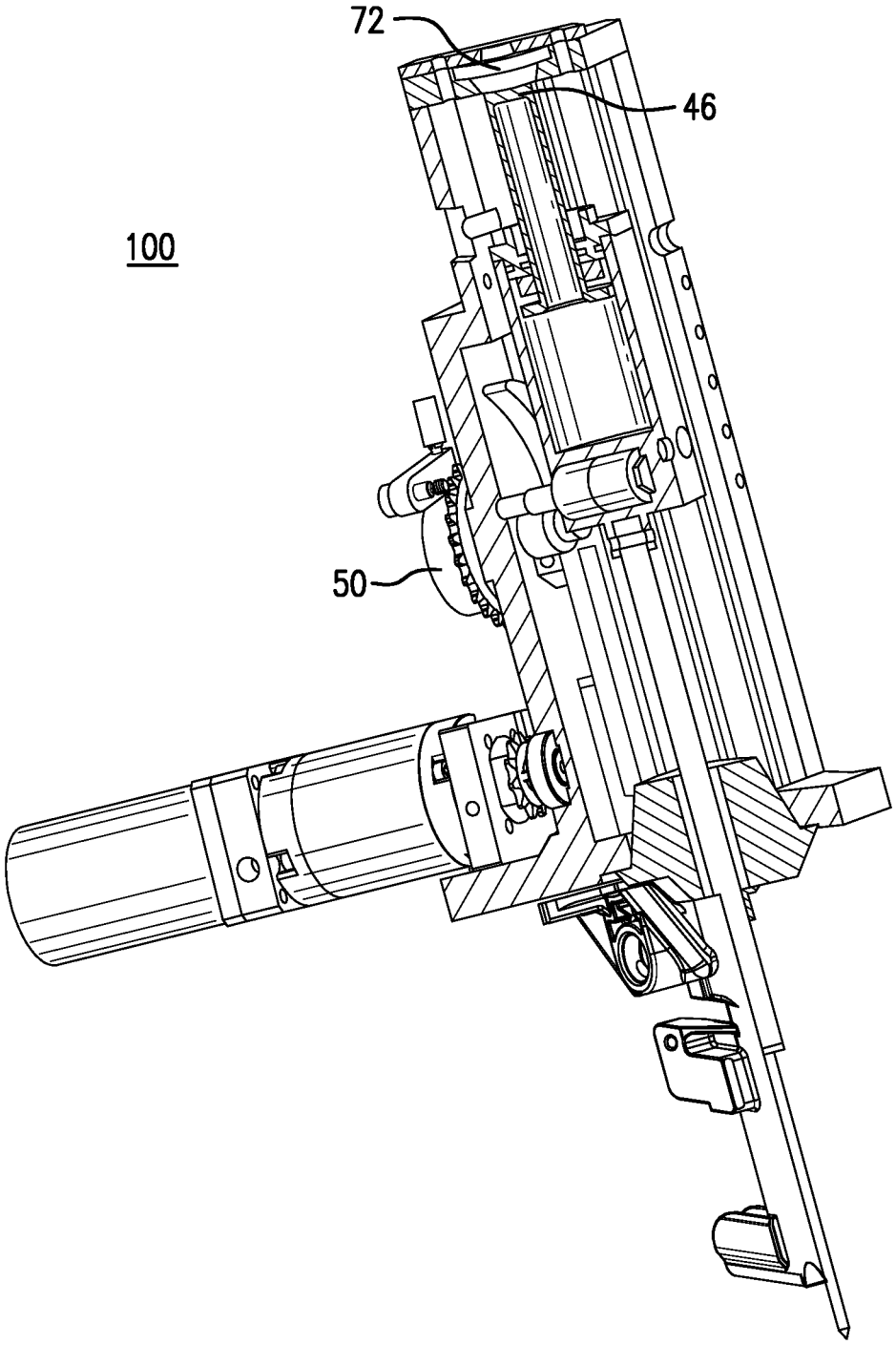
FIG. 3 shows a cutaway view of a fastener driving apparatus, in accordance with an exemplary embodiment of the present disclosure wherein a gas spring is releasing kinetic energy to the drive anvil assembly.
Figure 4:
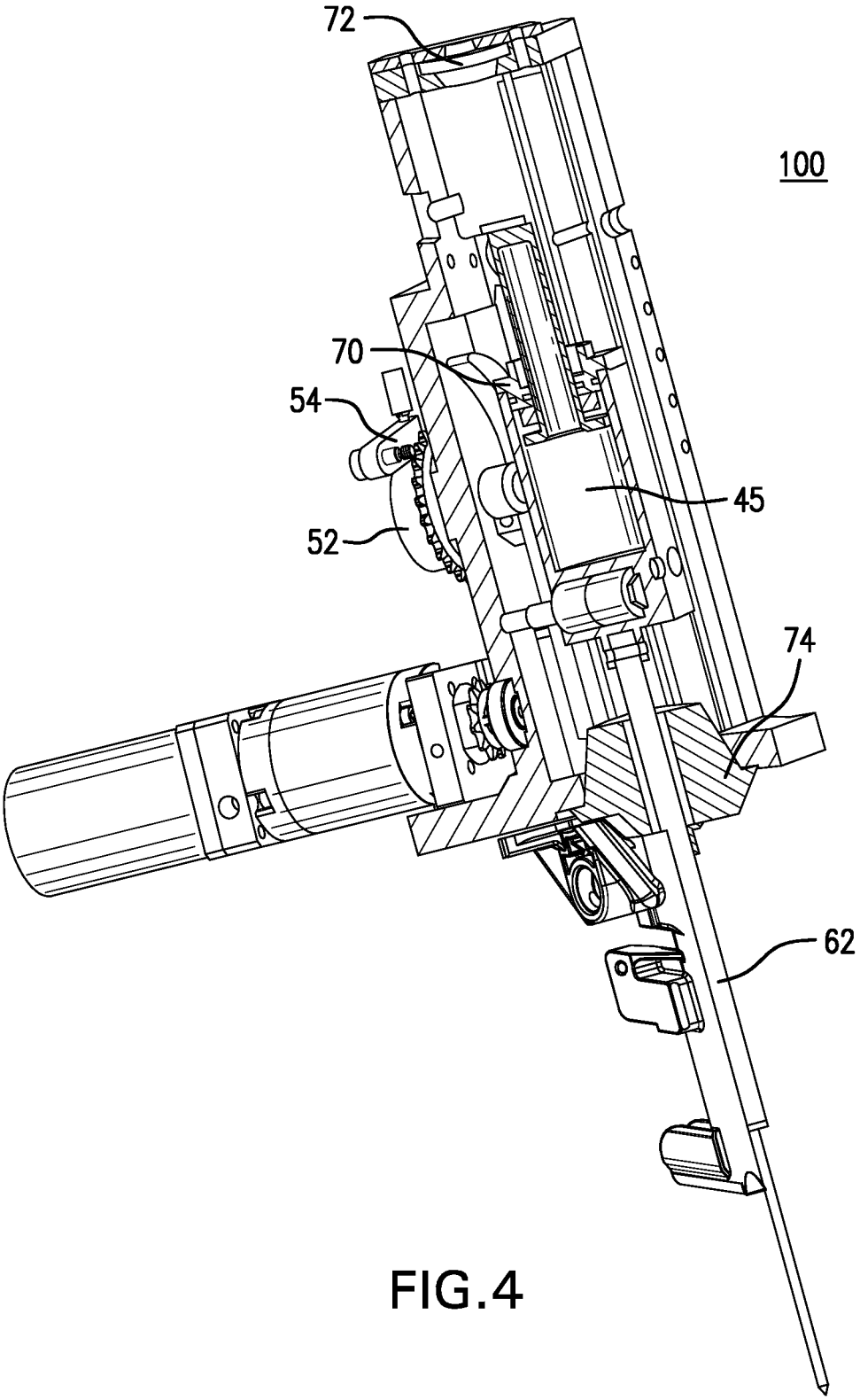
FIG. 4 shows a cutaway view of a fastener driving apparatus, in accordance with an exemplary embodiment of the present disclosure wherein a gas spring anvil assembly has separated from the pusher plate and is driving the fastener.
Figure 5:
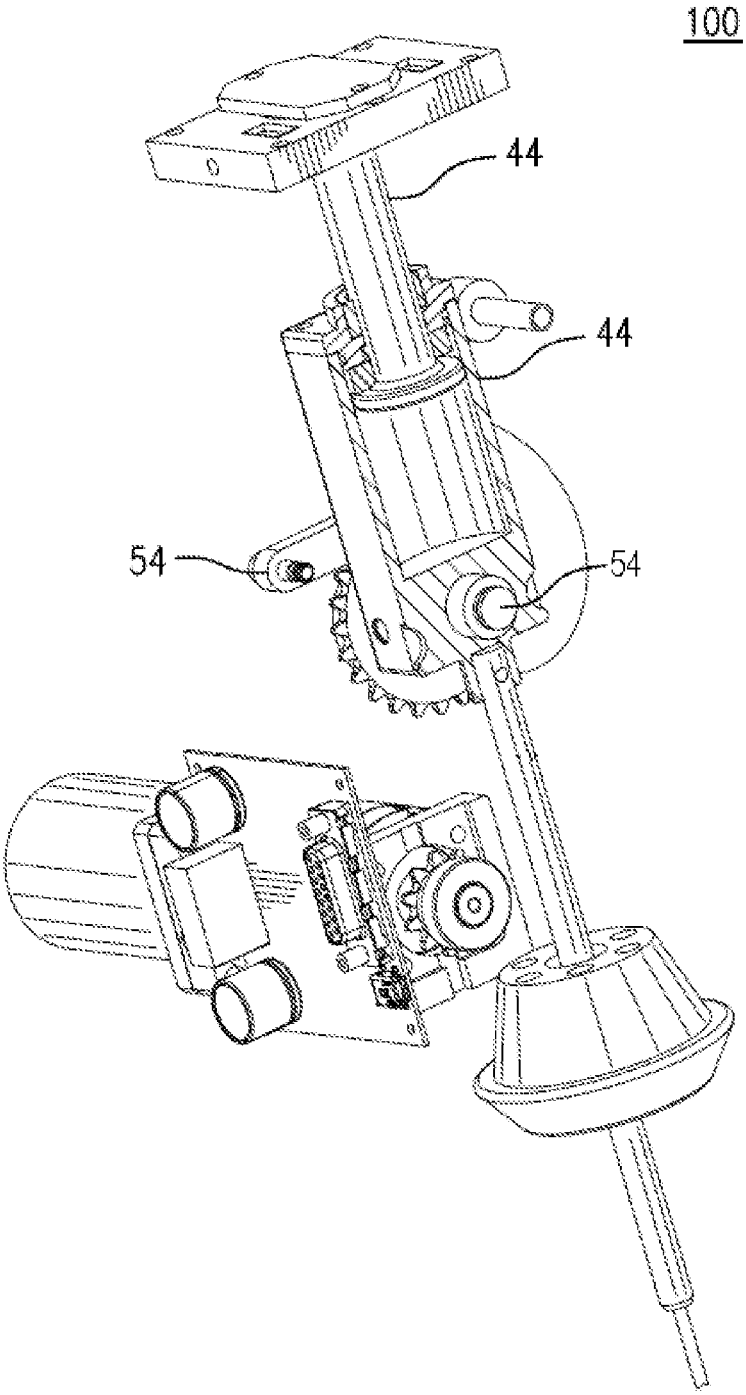
FIG. 5 shows a cutaway view of a fastener driving apparatus, in accordance with an exemplary embodiment of the present disclosure wherein the gas spring anvil assembly has returned to a starting position using a bungee as a return mechanism.
Figure 6:
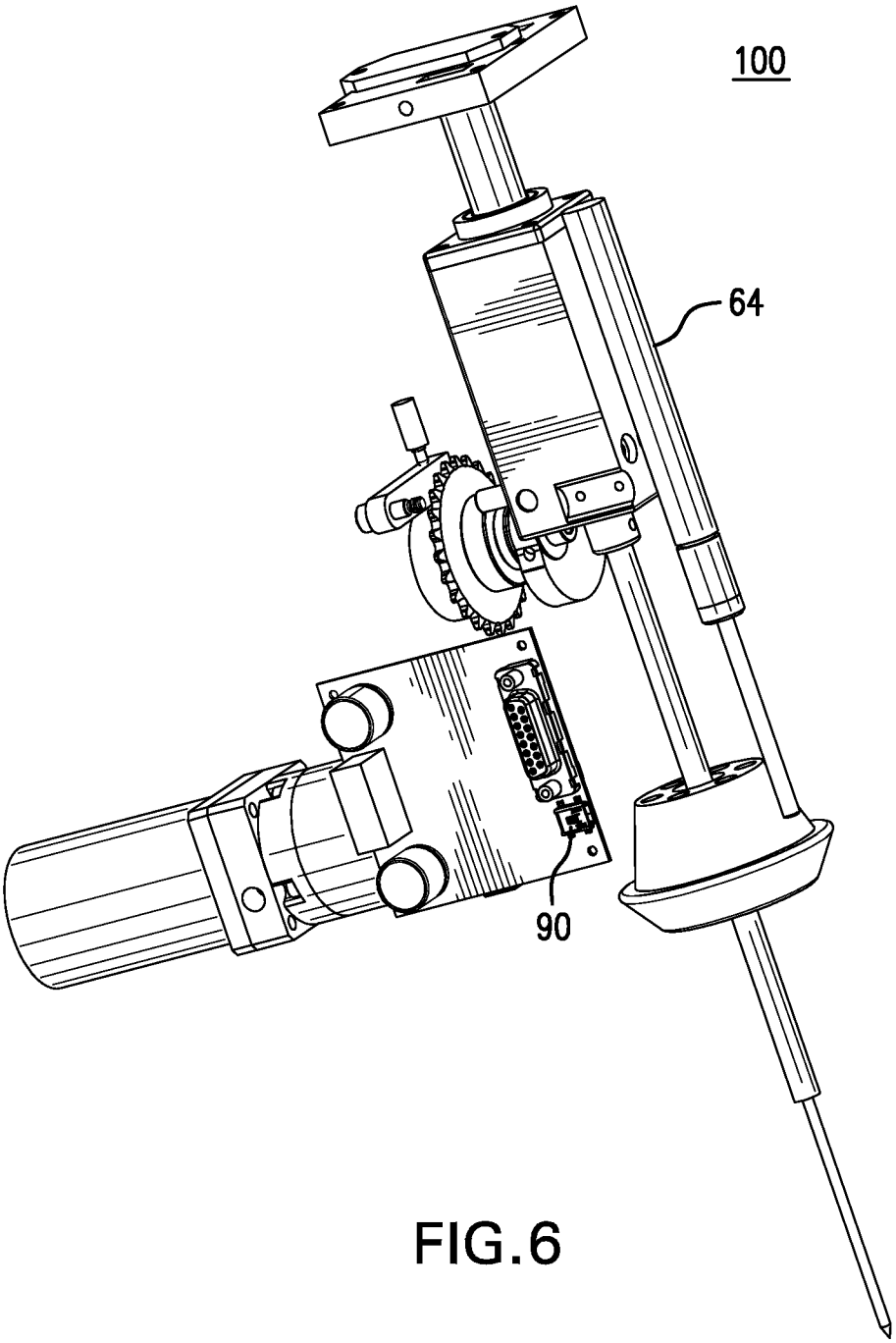
FIG. 6 shows a cutaway view of a fastener driving apparatus in accordance with an exemplary embodiment of the present disclosure wherein a gas spring anvil assembly has returned to a starting position using a spring as a return mechanism.

A mode for carrying out the present disclosure is presented in terms of its preferred embodiment, herein depicted in the accompanying figures. The preferred embodiments described herein detail for illustrative purposes are subject to many variations. It is understood that various omissions and substitutions of equivalents are contemplated as circumstances may suggest or render expedient, but are intended to cover the application or implementation without departing from the spirit or scope of the present disclosure. Furthermore, although the following relates substantially to one embodiment of the design, it will be understood by those familiar with the art that changes to materials, part descriptions and geometries can be made without departing from the spirit of the invention. It is further understood that references such as front, back or top dead center, bottom dead center do not refer to exact positions but approximate positions as understood in the context of the geometry in the attached figures.

The terms "a" and "an" herein do not denote a limitation of quantity, but rather denote the presence of at least one of the referenced items.

Referring to the figures, the present disclosure provides for a fastener driving apparatus 100. In an embodiment, the apparatus comprises a power source, a control circuit 20, a motor 30, a drive mechanism 50, a spring anvil assembly, an anvil return mechanism 64, and at least one bumper 70. The spring anvil assembly preferably comprises a gas spring 40, such gas spring including a piston 42, which piston is at least partially disposed within a sealed chamber 45, and which gas spring can store potential energy when selectively actuated by the drive mechanism. The spring anvil assembly also may comprise an anvil assembly 44 (which includes an anvil 62). The anvil assembly may further include a contact point such as cam follower 54 for engagement and disengagement from the drive mechanism. A bumper 70 is in proximity to and preferably disposed within the gas spring absorbs a portion of the force of impact of the piston 42 during an operative cycle. The gas spring further comprises a nose portion 46 which nose portion extends out of the chamber and which makes operative contact with a pusher plate 48 during a portion of the operational cycle of the apparatus. The pusher plate is simply a surface on which the nose portion 46 of the gas spring piston 42 acts to provide a reactionary force against the spring anvil assembly.

The drive mechanism may comprise, in an embodiment, a rack gear with intervals of teeth and no teeth. The drive mechanism preferably comprises a cam 52 and a cam follower 54 supported within the anvil assembly 44 by bearings 56 as illustrated in the figures. It will be apparent that the drive mechanism is configured to permit transition from an engagement period in which the potential energy of the gas spring and anvil assembly is increased to a disengagement period in which the potential energy from the gas spring is released and converted into kinetic energy in the anvil assembly. The drive mechanism is operatively coupled to allow the potential energy within the gas spring to increase by increasing the displacement of the gas spring piston 42 inside the sealed gas spring chamber 45, and in a particular embodiment, may alternate in actuating the piston (when the gear teeth or cam is engaged, for example) and in refraining from applying a drive force on the piston when the gear teeth and or cam become disengaged.

In an embodiment, the drive mechanism engages and actuates the piston (and/or anvil assembly) to store potential energy within the gas spring, which actuation of the piston may be referred to as an "energized position" of the piston. In an embodiment, the initial pressure (before the drive mechanism actuates the air piston) within the gas spring is at least 40 psia and more preferably greater than 200 psia and even more preferably greater than 1000 psia. The results of using these high pressures unexpectedly increases the efficiency of the apparatus in that now it is possible to limit the piston movement to a fraction of the total anvil or fastener drive movement, which results in improved efficiency, an improved safety profile and reduces wear on the apparatus. An additional unexpected efficiency improvement is the result that displacement of air as a gas spring piston moves from a sealed chamber to the ambient environment is a source of energy loss, as the piston must displace that atmospheric air pressure. By increasing the ratio of the internal pressure to atmospheric and limiting the stroke, that total volume of air displaced by the piston is reduced and efficiency was further unexpectedly increased.

The configuration and design of the gas spring are such that the pressure increase during the piston movement is preferably less than 30% of the initial pressure, which allows the drive mechanism to operate at a more constant torque, thus improving the motor efficiency. A further unexpected advantage of using a cam is that we were able to alter the cam profile to compensate for pressure and load changes on the piston which allowed for a more optimal motor and drive mechanism design. In an embodiment, the cam profile of the cam is configured such that the motor torque varies no more than 30% during the majority of the operational cycle in which the gas spring is being energized. Even more preferably, the torque is within a +/−30% band of the nominal loaded value for at least 70% of the cam rotation in which the gas spring is being energized. The drive mechanism thereafter disengages by having the cam 52 release from cam follower 54, allowing potential energy to act on the anvil assembly causing it to move in relation to the piston. For at least one portion of this movement, the front point of the piston 46 will separate from the pusher plate 48 and the entire spring anvil assembly (including the piston 42) will move to drive the fastener (as will be described in further detail below). During this portion, the gas spring piston ceases to exert an accelerating force on the spring anvil assembly. The drive mechanism is timed and/or configured using a sensor 90 for example to prevent further engagement with the gas spring (and/or anvil assembly) until after the anvil and/or anvil assembly has returned to an approximate starting position. The drive mechanism may thereafter again act on the piston (and/or anvil assembly) to again store potential energy within the gas spring and may thereafter again temporarily cease to act on the piston (and/or anvil assembly) to allow potential energy to instead act on the anvil assembly. In an embodiment, the stroke of the piston is less than the stroke of the spring anvil assembly, and in a further embodiment, the stroke of the piston is no more than 50% of the total stroke of the spring anvil assembly.

The anvil assembly is operatively coupled to the gas spring, such as to the piston such that when the drive mechanism ceases to exert a force on the gas spring the force from the piston on the pusher plate 48 causes the anvil assembly to move in a direction towards the fastener and for at least a portion of the fastener drive to have the piston nose separate from the pusher plate and drive a fastener, for example. In this particular disclosure it was discovered that combining the total moving mass into the thrown mass (i.e. including the piston) that the efficiency increased by about 20% over applicants' prior disclosure of U.S. patent application Ser. No. 14/877,742. In an embodiment, the piston is hollowed out to lighten its mass and further may be constructed of lightweight materials such as hard anodized aluminum, plastics or the like. The anvil 62 and/or anvil assembly may be operatively coupled to a guide, shaft, or other structure that limits and guides the range of motion of the anvil and/or anvil assembly A sensor 90 is provided for determining at least one of the position of the drive mechanism and the spring anvil assembly. The sensor may enable proper sequencing for actuation or stopping of the operational cycle. Additionally, the sensor can be used to determine if there has been a fastener jam during the operational cycle. In one example, the sensor is located near an initial position of the spring anvil assembly. A sensor located in this configuration could indicate readiness of the apparatus to start a cycle as well as if the cycle had completed without a jam, for example.

It was unexpectedly discovered in this invention that the use of at least one bumper 70 for absorbing a portion of the force of impact of the piston 42 within the gas spring greatly extended the life of the apparatus. This addition significantly reduced wear on the piston 42. It was further unexpectedly discovered that an additional bumper 72 which may be disposed between the nose 46 of the gas piston and the pusher plate 48 also reduced wear. (In an embodiment, said bumper may also be the pusher plate 48.) In another embodiment a still further bumper 74 may be disposed between the anvil assembly against a feeder or frame of the apparatus (feeder and frame not shown) to reduce wear on the components of the apparatus. The at least one bumper may be of an elastic material, and may be disposed on the apparatus at any position where it is capable of absorbing a portion of the various impact energies. The bumper more preferably is composed of a material with a coefficient of restitution of less than 50%.

The apparatus further comprises a return mechanism 64 to enable the anvil assembly and gas spring to return to a position where they can be again contacted and/or acted on by the drive mechanism. This return mechanism is preferably passive but can be powered such as from a motor or the like. In an embodiment, the return mechanism is a return spring that is disposed on or in a guide rod. In a more preferred embodiment the return spring is a second gas spring (referred to herein simply as a return spring to avoid confusion) that is contained within the thrown mass. In a still further embodiment, the return mechanism comprises at least one elastomeric compound such as a gum rubber, silicone rubber or the like. After the gas spring causes the anvil to move, and after or in connection with the anvil impacting and driving a fastener, the return mechanism imparts a force on the anvil, anvil assembly or gas spring to cause the gas spring and anvil assembly to return to a position where the gas spring is again in a position to store potential energy when operatively acted upon by the drive mechanism. In the embodiment where the return mechanism is a return spring or elastomer the return mechanism may be disposed with respect to the anvil such that motion of the anvil toward a fastener to be driven also causes an increase in potential energy in the return mechanism, and motion away from the fastener causes the return mechanism to release the stored potential energy and to actuate the anvil assembly to the anvil's earlier or original position. In a still further embodiment, where the return mechanism is a return spring or elastomer, the ratio of return mechanism force to spring anvil assembly weight results in an acceleration of at least 50 inches/second$^2$.

In a further embodiment, the gas spring assembly is primarily composed of aluminum, magnesium, plastic or other low density materials to reduce the total moving mass weight. In a further embodiment, the total moving mass weight to apparatus weight is less than 25% and more preferably less than 10%.

Figure 7:
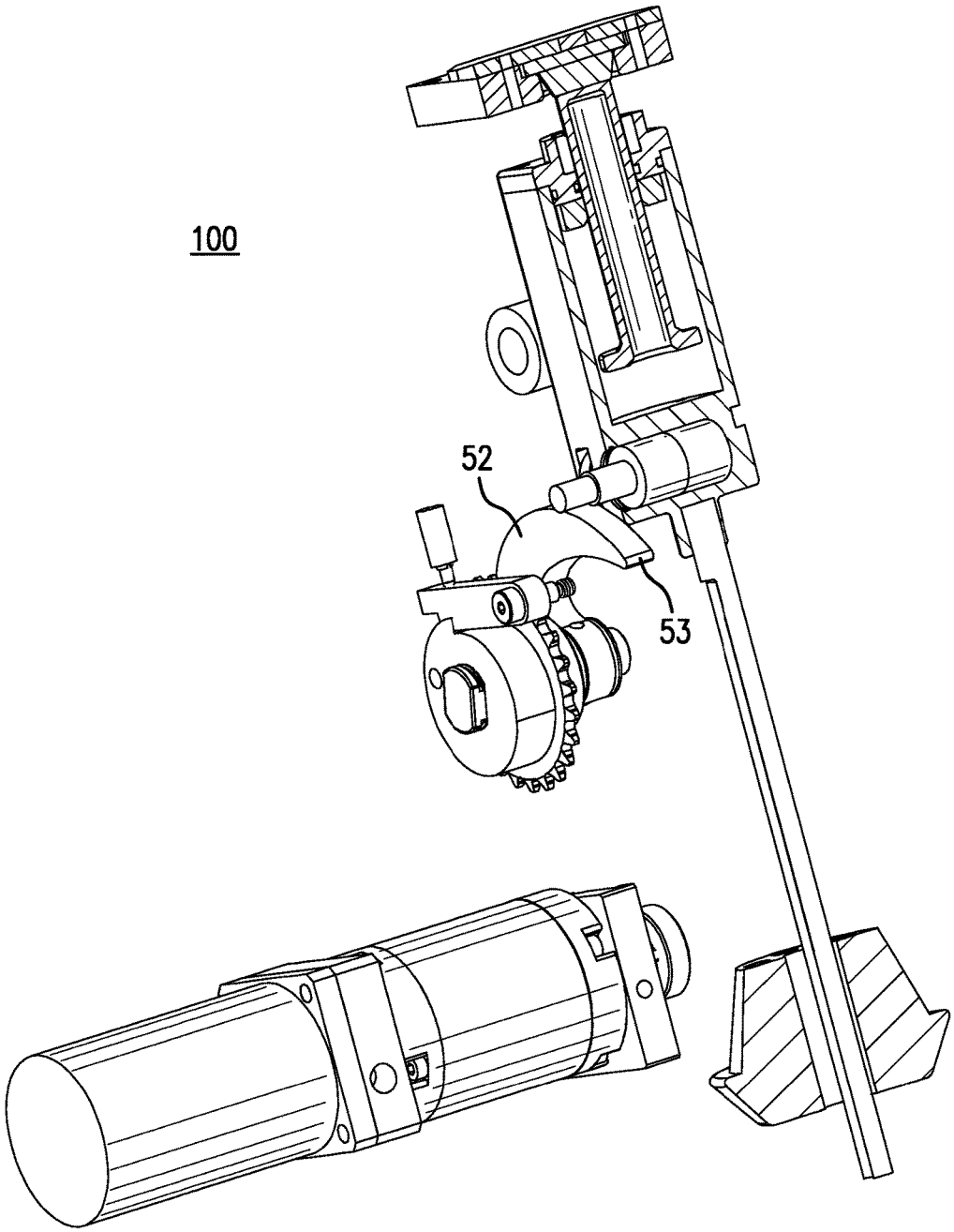
FIG. 7 shows a cutaway view of a fastener driving apparatus in accordance with and exemplary embodiment of the present disclosure in wherein the gas spring piston has been stopped at an intermediate point of energy storage.

In a further embodiment, an intermediate stoppage point is provided within the drive mechanism as shown in FIG. 7. This allows the drive mechanism 50 to stop and retain the partially energized gas spring prior to imparting a force on the anvil and/or anvil assembly. In an embodiment, the stoppage point is anywhere from approximately 50% of the stroke of the piston into the gas spring to 90% of the stroke of the piston within the gas spring. The storage of a portion of the total potential energy used during a cycle of the apparatus allows for an improved user experience by reducing the latency. Although the mechanism shown in FIG. 7 is a modified pawl 53 and cam 52, it is apparent that the depicted mechanism is exemplary and that other devices for stopping and retaining the drive mechanism may be provided, such as a wrap spring or a one-way clutch. This embodiment allows for a significant improvement in the user experience and yet because of the design of the apparatus retains significant safety over other designs in that the motor must be re-energized to allow the fastener driving mechanism to drive the fastener. In the case of a preferred motor such as a brushless motor, this is an unlikely event due to the method in which brushless motors are controlled.

The present disclosure offers the following advantages: the gas spring is capable of generating a relatively high amount of force in a small amount of space such that the size of the apparatus may be smaller than other fastener drivers. Further, because of the relatively small increase from the initial pressure in the gas spring to the maximum pressure, the motor of the apparatus is not significantly overworked or overtorqued, thus leading to a longer useful life of the apparatus. Furthermore, the disclosed apparatus has an improved safety profile. For example, if a nail becomes jammed, the potential energy of the gas or air spring does not act directly on the fastener, and thus when the user removes the jammed fastener, there is reduced potential for injury. The present disclosure also has an improved recoil force as opposed to conventional and prior fastener driving devices. This improvement arises in part as the anvil/anvil assembly is a free traveling mass within the fastener driving apparatus for at least part of the cycle. As such during the course of the driving of the fastener the apparatus does not put additional reactionary force on the operator when the fastener is driven. For purposes of this disclosure, "free traveling mass" and "free flight", means that the spring anvil assembly or anvil assembly has disengaged from the drive mechanism and the piston is no longer exerting an accelerating force on the anvil assembly. During this free flight, the anvil assembly may be in frictional contact with a guiding system and may be in contact with the fastener and the return mechanism. In contrast and in prior art tools and patents such as U.S. Pat. No. 8,602,282, air pressure on the piston and anvil assembly acts during the entire drive and the end of the stroke can result in significant recoil to the operator, especially in the case of a jam or a nail fired into a hard substrate or in the case of larger nails such as framing nails.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the disclosure and various embodiments with various modifications as are suited to the particular use contemplated.

What is claimed is:

1. A fastener driving apparatus, the apparatus comprising
a power source,
a control circuit,
a motor,
a spring anvil assembly, said spring anvil assembly comprising a gas spring and an anvil,
said gas spring comprising a chamber and a piston,
a drive mechanism capable of selectively engaging and disengaging said spring anvil assembly
wherein when said drive mechanism selectively engages said spring anvil assembly potential energy is increased in said gas spring and when said drive mechanism disengages said spring anvil assembly, potential energy from said gas spring decreases while accelerating the spring anvil assembly to drive a fastener,
wherein during at least a portion of said drive stroke said drive mechanism disengages said spring anvil assembly and said gas spring piston does not exert an accelerating force on said spring anvil assembly.

2. The fastener driving apparatus of claim 1, wherein the total stroke of said gas spring piston is no more than 50% of the total stroke of said spring anvil assembly.

3. The fastener driving apparatus of claim 1, wherein the pressure increase within the gas spring caused by movement of said gas spring piston is less than 30%.

4. The fastener driving apparatus of claim 1, wherein said control circuit further comprises at least one sensor, wherein said at least one sensor may determine at least one of the position of said spring anvil assembly and the position of said drive mechanism.

5. The fastener driving apparatus of claim 1, wherein the drive mechanism comprises an intermediate stoppage point for storing or retaining of potential energy in the gas spring while the motor is de-energized and wherein the latency after the drive mechanism is restarted from said intermediate stoppage point is less than 100 milliseconds.

6. The fastener driving apparatus of claim 1, said apparatus comprising a bumper for absorbing the impact of the gas spring piston during an operational cycle of the apparatus.

7. The fastener driving apparatus of claim 1, further comprising a return mechanism for biasing said anvil assembly to a position where said gas spring is in a position to be re-energized.

8. The fastener driving apparatus of claim 7, wherein the return mechanism comprises one of a return spring (which can be mechanical or gas) or elastomer.

9. The fastener driving apparatus of claim 7, wherein the force of the return mechanism results in an acceleration of the spring anvil assembly of at least 50 inches per second squared.

10. The fastener driving apparatus of claim 1, said apparatus further comprising a pusher plate, wherein said spring anvil assembly ceases to act on a pusher plate prior to said anvil completing 50% of the drive of a fastener.

11. The fastener driving apparatus of claim 1, wherein the gas spring has a pressure of at least 300 psia for one portion of the operational cycle.

12. The fastener driving apparatus of claim 1 wherein the gas of said gas spring are comprised primarily of a non oxidizing gas such as nitrogen and inert gas.

13. The fastener driving mechanism of claim 1, wherein said drive mechanism comprises a cam, said cam comprising a cam profile, and wherein said cam profile is configured such that during the portion of the operational cycle in which the gas spring is being energized, the required torque to operate the cam varies no more than 30% for at least 70% of the cam rotation in which the gas spring is being energized.

14. The fastener driving apparatus of claim 1, wherein the mass of said spring anvil assembly is less than 15% of the mass of the apparatus.

15. A fastener driving apparatus, the apparatus comprising a power source, a control circuit, a motor, a gas spring, said gas spring comprising a chamber and a piston, an anvil assembly comprising an anvil, a drive mechanism capable of selectively engaging and disengaging said gas spring wherein said drive mechanism is capable of selectively engaging said gas spring and thereafter disengaging from said spring to cease applying a force on said gas spring, wherein when said drive mechanism engages said gas spring, potential energy is stored in said gas spring, and when said drive mechanism thereafter disengages said gas spring said gas spring releases its potential energy and accelerates said anvil assembly, said anvil assembly being in a state of free flight for at least a portion of the drive stroke.

16. The fastener driving apparatus of claim 15, wherein the total stroke of said gas spring piston is no more than 50% of the total stroke of said anvil.

17. The fastener driving apparatus of claim 15, further comprising a return mechanism for biasing said gas spring to a position where said gas spring is in a position to be re-energized.

18. The fastener driving apparatus of claim 15, wherein the gas spring has a pressure of at least 300 psia for one portion of the operational cycle.

19. The fastener driving apparatus of claim 15, wherein the mass of said anvil assembly is less than 15% of the mass of the apparatus.

* * * * *